US007191704B2

(12) United States Patent
Held

(10) Patent No.: US 7,191,704 B2
(45) Date of Patent: Mar. 20, 2007

(54) CONVEYOR UNIT FOR CONVEYING FLAT OBJECTS

(75) Inventor: Berthold Peter Held, Heuchelheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 11/221,881

(22) Filed: Sep. 9, 2005

(65) Prior Publication Data

US 2006/0065141 A1 Mar. 30, 2006

Related U.S. Application Data

(62) Division of application No. 10/494,045, filed as application No. PCT/DE02/04106 on Nov. 6, 2002, now Pat. No. 7,007,603.

(30) Foreign Application Priority Data

Nov. 14, 2001 (DE) ..... 101 60 754

(51) Int. Cl.
*B41F 13/24* (2006.01)

(52) U.S. Cl. ..... 101/232; 270/21.1; 271/198

(58) Field of Classification Search ..... 101/219, 101/183, 181, 232; 271/69, 198, 199; 270/4, 270/12, 15, 17, 18, 20.1, 21.1
See application file for complete search history.

(56) References Cited

U.S. PATENT DOCUMENTS

| | | | | |
|---|---|---|---|---|
| 2,278,188 | A * | 3/1942 | Ritzau et al. | 270/60 |
| 2,788,738 | A * | 4/1957 | Wood | 101/171 |
| 3,363,520 | A | 1/1968 | Obenshain | |
| 4,094,499 | A | 6/1978 | Thomas | |
| 4,516,759 | A | 5/1985 | Kobler | |
| 5,230,268 | A | 7/1993 | Richter | |
| 5,405,126 | A | 4/1995 | Mack | |
| 5,735,516 | A | 4/1998 | Gerlier et al. | |
| 6,752,078 | B2 | 6/2004 | Blanchard et al. | |

FOREIGN PATENT DOCUMENTS

| | | |
|---|---|---|
| DE | 94 17 127.0 | 2/1995 |
| EP | 0 205 143 A2 | 12/1986 |
| EP | 0 575 711 A1 | 12/1993 |

* cited by examiner

*Primary Examiner*—Ren Yan
(74) *Attorney, Agent, or Firm*—Jones, Tullar & Cooper, P.C.

(57) ABSTRACT

A conveyor unit for conveying flat objects includes at least first, second and third endless belts, together with a cylinder. The first endless belt extends along a part of the circumference of the cylinder and forms, with the cylinder circumference, a section of a path of conveyance for the objects. The second and third belts define another section of the path of conveyance.

6 Claims, 1 Drawing Sheet

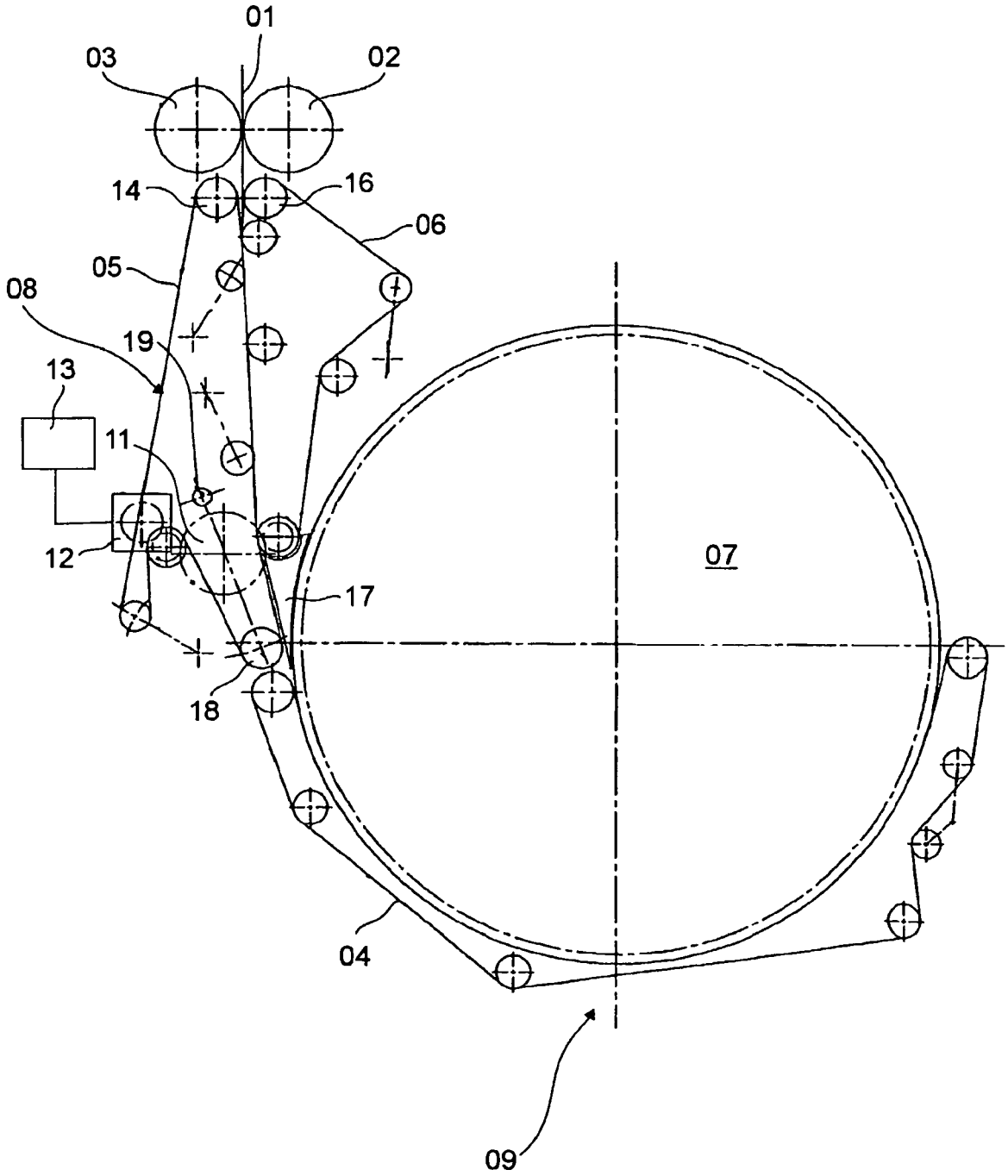
01
03
02
14
16
06
05
08
19
13
11
12
07
17
18
04
09

CONVEYOR UNIT FOR CONVEYING FLAT OBJECTS

CROSS-REFERENCE TO RELATED APPLICATIONS

This application is a division of U.S. application Ser. No. 10/494,045, filed May 11, 2004, now U.S. Pat. No. 7,007, 603, issued Mar. 7, 2006. That application was the U.S. National Phase, under 35 U.S.C. 371 of PCT/DE2002/04106, filed Nov. 6, 2002; published as WO 2003/045826 on Jun. 5, 2003, and claiming priority to DE 10160754.7, filed Nov. 14, 2001, the disclosures of which are expressly incorporated herein by reference.

FIELD OF THE INVENTION

The present invention is directed to a conveyor unit for flat objects. The conveyor unit has at least first and second endless belts and a cylinder embodied as a collection cylinder.

BACKGROUND OF THE INVENTION

Conveyor units are typically employed in folding apparatus, for example, for conveying signatures which had been previously cut from a web of an imprinted material.

The signatures each consist of a variable number of sheets which are not connected to each other. For conveying the signatures, it is therefore of great importance that the two endless belts and the cylinder of the conveyor unit move at exactly matched speeds in order to avoid any shearing forces acting on signatures clamped between them, which shearing forces could lead to deformation and to fanning of the signatures in the course of their being transported.

In conventional conveyor units of the above-mentioned type, the first endless belt, which partially loops around the surface of the cylinder, is driven by the cylinder, by friction. Therefore, if no objects are conveyed between them, the path speed of the first belt corresponds to the circumferential speed of the cylinder. If conveyed objects are located in the area of the loop between the cylinder and the first belt, this has an effect on the speed of the first belt, which acts as it would with an increase of the diameter of the cylinder. Therefore, the speed of the first belt increases in accordance with the thickness of the objects to be conveyed. The movement of the second belt is coupled to the rotation of the cylinder at a fixedly set transmission ratio via a speed-transforming gear. Therefore, the speed of the second belt is constant. This results in the two belts only running exactly at the same speed at a defined thickness of the objects to be conveyed, so that the objects are not subjected to shearing forces only during this operating condition.

DE 94 17 127 U1 and EP 0205143 A2 both describe a collection cylinder, against whose circumference a belt system rests and which is provided with sheets via two further cooperating belt systems.

U.S. Pat. No. 5,405,126 describes a folding apparatus with belts driven by an electric motor.

U.S. Pat. No. 3,363,520 discloses a collection cylinder for sheets, having several belts. One belt is driven by the collection cylinder.

SUMMARY OF THE INVENTION

The object of the present invention is directed to providing a conveyor unit for flat objects.

In accordance with the present invention, this object is attained by the provision of a conveyor unit for conveying flat objects and having at least first and second endless belts and a cylinder which is embodied as a collection cylinder. The conveyor unit is located downstream of a cutter unit. A conveying path is defined, on one side, by at least the first endless belt, and on the other side by a portion of the circumference of the cylinder and the second endless belt. The first endless belt extends around a portion of the circumference of the cylinder. The conveying path is defined, with respect to the second endless belt, by a third endless belt.

The advantages which can be gained by the present invention consist, in particular, in that it is possible to provide synchronous running between both sides of the conveying path over their entire length even in case of different thicknesses of the object to be conveyed. Objects can thus be conveyed gently and free of shearing forces.

For this purpose, it has been provided that the conveying path of the conveyor unit is divided into two sections which follow each other. In one section, a portion of the circumference of the cylinder and the first conveyor belt lie opposite each other. A second conveyor belt and a third conveyor belt lie opposite each other in a second section.

It is possible by the use of a coupling, and in particular by the use of a mechanical coupling, to reduce deviations in the speed of the movement of the second and third endless belts to exactly zero. Accordingly, regardless of the length of the section of the conveying path delimited by these endless belts, no shearing of the conveyed products can occur.

In accordance with a first, simple preferred embodiment of the present invention, the second and the third endless belts are coupled to the rotating movement of the cylinder by a speed-transforming gear. The transmission ratio of the speed-transforming gear is fixed in such a way that the speeds of the second and third endless belts coincide exactly with the circumferential speed of the cylinder.

In accordance with a more elaborate preferred embodiment of the present invention, a drive mechanism for the second and third endless belt can be regulated independently of the rotary speed of the cylinder. By this, it is possible to adjust the speed of the second and third belts in response to the respective thickness of the conveyed product, and to adjust the speed of the first endless belt resulting from this. Small deviations from a speed of the second and third belts, which would be optimal in view of the deformation-free conveyance of the products and in view of their actual speed, can be tolerated more easily than in connection with the above explained conveyor unit. With the conveyor unit in accordance with the present invention, such a deviation leads to only a slight tensional stress or to a slight transient compression of the products in the course of their transfer from one section of the conveyor unit to the other, depending on which one is the faster. No shearing can occur. For such shearing to occur, it would be necessary that the belts of different speeds be located opposite each other.

The optimum speed must equal the speed of the first endless belt or must equal the circumferential speed of the cylinder, or must lie between these two values. The mean value of the speeds of the first belt and of the cylinder, in particular, can be used as the optimal speed. This corresponds to the position of the neutral fiber of the product, i.e. to a position of a fictional line in the product located exactly in the center of the product which neutral fiber, in the course of the product being conveyed on the cylinder, is neither stretched nor compressed.

A regulating device is usefully assigned to this drive mechanism, and works toward accomplishing a matching of the speeds of the second and third belts with the optimal speed. This regulating device preferably proportionally regulates the speed of the second belt by a variable proportionality factor in relation to the speed of rotation of the cylinder.

By adjusting the proportionality factor, as a function of the thickness of the conveyed objects, the stretching or compression stress imparted to the conveyed objects, during the transfer of the conveyed objects from one section of the conveying path to the other, is minimized.

For determining the proportionality factor, the regulating device can be coupled with a sensor for measuring the speed of the first belt. The speed of the first belt varies linearly with the thickness of the conveyed object. Freedom from stretching or compression stresses can be achieved by a simple matching of the speeds of all belts.

A further option lies in coupling a sensor, which is usable for detecting the thickness of the objects, with the regulating device. Such a sensor can be arranged, in particular, prior to the inlet of the conveyor unit. The belt speeds of the conveyor unit can then be matched to a changed product thickness even before the object on which the thickness measurement was performed, reaches the conveyor unit.

BRIEF DESCRIPTION OF THE DRAWING

A preferred embodiment of the present invention is represented in the sole drawing and will be described in greater detail in what follows.

The sole drawing FIGURE represents a schematized section through a conveyor unit in accordance with the present invention.

DESCRIPTION OF THE PREFERRED EMBODIMENT

The conveyor unit of the present invention, as shown in the sole drawing FIGURE, is arranged following a cutter unit that is formed of a cutter cylinder 02 and a grooved cylinder 03 located opposite it. By the operation of this cutter unit, a web 01 of material, for example a paper web 01, which has been cut in a superstructure located above the cutter unit, and not shown in the sole drawing, into strands with the aid of several rotating linear cutters, which strands are placed one above the other, and the web of material 01 is cut into individual signatures in the cutter unit. Therefore, the signatures consist of a different number of sheets of paper lying on top of each other, which sheets of paper are not firmly attached to each other and which are therefore open at all four sides.

The path along which the signatures are conveyed in the conveyor unit located after the cutter unit can be divided into two sections. A first section 08, is one in which the signatures are conveyed, pressed against each other, between two endless belts 06, 05, called a second and third endless belt here. A second section 09, is one in which the signatures are conveyed between a first endless belt 04 and a cylinder 07, for example a collection cylinder 07 of a rotary printing press.

In a transition zone between the first section 08 and the second section 09, the signatures are conducted through a wedge-shaped tongue 17, which is situated on the side facing the collection cylinder 07. A lower deflection roller 18, which carries the third endless belt 05, has been mounted, which lower deflection roller 18 is pivotable around a pivot shaft 19 and which maintains the tension of the third endless belt 05, and in this way provides access to the tongue 17 for exchanging or for performing maintenance on tongue 17.

The collection cylinder 07 is driven by a motor, which is not specifically represented in the drawings. The first endless belt 04, which forms the second section 09 of the conveyor unit and which loops around the collection cylinder 07 over an angle area of approximately 180°, is driven by friction resulting from its contact with the peripheral surface of the collection cylinder 07. When the signatures are conveyed in the second section 09, they transfer the driving force from the collection cylinder 07 to the first endless belt 04.

Because of their greater relative distance from the center of rotation of the collection cylinder 07, with respect to the inside portion of the signatures, the outside portion of the signatures, i.e. the signature portion facing away from the collection cylinder 07 have a slightly greater path speed than the surface area of the collection cylinder 07 itself. The speed difference is proportional to the thickness of the signatures. Therefore, the speed of the first endless belt 04 is automatically adapted to the changing thickness of the signatures.

The second endless belt 06, and the third endless belt 05 are together driven at the same speed via an intermediate drive wheel 11 by a drive mechanism 12, which drive mechanism 12 may be, for example, a frequency-regulated motor 12. In this way, no shearing at all can occur during the transport of the signatures in the first section 08 of the conveyor unit. The speed of the motor 12 is regulated by a regulating device 13, whose job is to maintain the path speeds of the two endless belts 05, 06 at a suitable value which is matched to the transport speed of the signatures in the second section 09 of the conveyor unit, and in this way, to prevent the sheets of the signatures from being displaced, in relation to each other, during their transition from the first section 08 to the second section 09, or to prevent the signatures from being compressed, so that the signatures become unsightly or unusable.

A first option for controlling the path speed of the three endless belts 04, 05, 06 is to match the speed of the second and third endless belt 06 or 05 to that of the first endless belt 04. The result is that a signature which is transferred from the first section 08 to the second section 09 of the conveying path is not subjected to any stretching or compression, at least on their side facing the third and first endless belts 05 or 04. Since, as described above, the speed of the first endless belt 04 is a function of the speed of the collection cylinder 07 and of the thickness of the signatures to be conveyed, an active regulation of the speed of the various endless belts is necessary.

In accordance with the present invention, the regulating device 13 is connected with two speed sensors for sensing the path speeds of the third and the second endless belts 05, or 06, and acts toward the matching of these two path speeds. The speed sensors can be angle of rotation sensors, for example, which are respectively arranged at a deflection roller 14 or 16 of the third or second endless belt 05, 06, and which transmit a pulse to the regulating device 13 every time the deflection rollers 14, 16 have traveled over a fixed angle of rotation. These angle of rotation sensors are preferable identically constructed and are mounted on the deflection rollers 14, 16 which rollers 14, 16 are of identical radii. In this case, the regulating device 13 can assure an identical path speed of the two endless belts 05, 06 by maintaining a constant, and preferably diminishing phase offset between the pulses provided by the two sensors. In that case, the speed of the second and third endless belts 06, 05 is proportional to the speed of the collection cylinder 07 in accordance with a proportionality factor, wherein the proportionality factor is determined by the thickness of the signatures conveyed between the collection cylinder 07 and the first endless belt 04.

Another option for regulating the speed of the second endless belt 06 is to connect the regulating device 13 on the one side with a sensor for the speed of the first endless belt 04 or for the rotational speed of the collection cylinder 07, and on the other side with a sensor for the thickness of the signatures to be conveyed. The regulating device 13 then calculates a speed to be maintained by the motor 12 from the measured speed of the first endless element 04, corrected by a proportionality factor which is determined depending on the measured thickness of the signatures to be conveyed. A sensor, for determining the thickness of the signatures to be conveyed or for determining a value proportional to the signature thickness, can be arranged at a location which is arbitrary, to a large extent, in the conveyor unit or, even better, at a location adjacent the web 01 of material prior to the intake of the web of material into the conveyor unit.

It is also conceivable that an operator can set a known thickness of the signatures, the number of sheets in the signature, and their basis weight, or other arbitrary equivalent combinations of parameters in a control unit of the regulating device.

An operator can also perform subsequent corrections with such a control unit if it is noticed that the signatures conveyed by the conveyor unit are being sheared or have been sheared.

In accordance with a simplified second preferred embodiment of the present invention, the intermediate drive wheel 11, which drives both the two endless belts 05, 06, is coupled by a gear which is not specifically represented, and having a fixed gear ratio, to the rotation of the collection cylinder 07. The gear ratio of the not depicted gear has been selected to be such that the path speed of the two endless belts 05, 06 is equal to the circumferential speed of the collection cylinder 07. With this embodiment, the third endless belt 05 runs slightly slower than the first endless belt 04 following it in the conveying path. As a result of the equality of the path speeds of the endless belts 05, 06 and the circumferential speed of the collection cylinder 07, a signature is not subjected to any shearing or compression forces at the transition between the first conveyor section 08 and the second conveyor section 09, at least at the signature side facing the second endless belt 06 and the collection cylinder 07. A slight stretching stress can occur at the opposite side of the substrate in contact with the endless belts 05, 04, since the endless belt 04 moves slightly faster than the endless belt 05.

Such a stretching stress can be acceptable in the situation of small thicknesses of the signatures, and therefore in the case of small differences between the speeds of the first endless belt 04 and of the remaining endless belts 05, 06. However, if the thickness of the signatures becomes too great, and if therefore the speed difference between the collection cylinder 07 and the first endless belt 04 becomes too great, a slight shearing force might occur on the signatures during the transfer of a signature between the two conveyor sections 08 and 09.

In contrast thereto, with the use of the above-described first embodiment, only a compression force acts on the signature at the moment of transfer. This compression force cannot result in a sliding of individual sheets of the signature. In the situation of processing thick signatures the technically more elaborate first embodiment might be preferred over the simpler, and more cost-effective second one.

In principle it is, of course, possible to set any arbitrary speed, which arbitrary speed lies between the circumferential speed of the collection cylinder 07 and the path speed of the first endless belt 04, as the conveying speed of the conveying endless belts 05, 06 of the first section 08. If, for example, the average value of the circumferential speed of the collection cylinder 07 and the path speed of the endless belt 04 in the second conveying section is selected as the path speed of the first conveying section 08, a slight compression or speed reduction acts on the surface of the signature facing the collection cylinder 07 during the transfer to the second section, while the oppositely located surface of the signature facing the endless belts 05, 04 is stretched or accelerated.

While preferred embodiments of a conveyor unit for conveying flat objects, in accordance with the present invention, have been set forth fully and completely hereinabove, it will be apparent to one of skill in the art that various changes in, for example, the size of the collection cylinder, the type of web being conveyed, and the like could be made without departing from the true spirit and scope of the present invention which is accordingly to be limited only by the following claims.

What is claimed is:

1. A conveyor unit for conveying flat objects comprising:

a collection cylinder having a circumferential surface, said collection cylinder being located after, in a direction of object travel, a cutter unit;

a first endless belt extending around a portion of said collection cylinder and cooperating with said collection cylinder circumferential surface and defining a section of a conveying path;

a second endless belt and a cooperating third endless belt defining a balance of said conveying path and being located intermediate said cutter unit and said collection cylinder, said first and third endless belts defining a first side of said conveying path, said second conveyor belt and said collection cylinder circumferential surface defining a second side of said conveying path; and a speed-transforming drive gear coupling each of said second and third endless belts to said collection cylinder, said speed-transforming drive gear having a gear ratio selected such that a speed of said second and third endless belts is equal to a circumferential speed of said collection cylinder, said third endless belt and said second endless belt being mechanically coupled through said drive gear.

2. The conveyor unit of claim 1 wherein said drive gear directly drives said second endless belt and said third endless belt.

3. The conveyor unit of claim 1 further including an intermediate gear wheel between said drive gear and said second and third endless belts.

4. The conveyor unit of claim 1 wherein said second and third endless belts are out of contact with said collection cylinder.

5. The conveyor unit of claim 1 wherein a start of said section of said conveying path follows an end of said balance of said conveying path.

6. The conveyor unit of claim 1 further including a last deflection roller of said third endless belt and a first deflection roller of said first endless belt, said last deflection roller and said first deflection roller being arranged directly adjacent.

* * * * *